US007261513B2

(12) United States Patent
Umeyama et al.

(10) Patent No.: US 7,261,513 B2
(45) Date of Patent: Aug. 28, 2007

(54) CENTRIFUGAL COMPRESSOR

(75) Inventors: Ryo Umeyama, Kariya (JP); Hisao Hamasaki, Kariya (JP); Kazuho Yamada, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 35 days.

(21) Appl. No.: 11/280,147

(22) Filed: Nov. 15, 2005

(65) Prior Publication Data

US 2006/0115358 A1 Jun. 1, 2006

(30) Foreign Application Priority Data

Dec. 1, 2004 (JP) ..... 2004-347930
Dec. 14, 2004 (JP) ..... 2004-360877
Nov. 2, 2005 (JP) ..... 2005-318932

(51) Int. Cl.
*F04D 29/44* (2006.01)

(52) U.S. Cl. ..... 415/52.1; 415/58.4; 415/53.1

(58) Field of Classification Search ..... 415/206, 415/144, 52.1–59.1
See application file for complete search history.

(56) References Cited

U.S. PATENT DOCUMENTS 2,161,182 A * 6/1939 Massey ..... 415/147
2,399,072 A * 4/1946 Thompson ..... 415/52.1
3,749,520 A * 7/1973 Bandukwalla ..... 416/183
3,869,220 A * 3/1975 Tayler ..... 415/57.1
5,255,514 A * 10/1993 Wentworth, Jr. ..... 60/605.1
6,860,715 B2 * 3/2005 Sekularac ..... 415/115

FOREIGN PATENT DOCUMENTS

JP 6-76697 3/1994
JP 8-291800 11/1996

* cited by examiner

*Primary Examiner*—Igor Kershteyn
(74) *Attorney, Agent, or Firm*—Morgan & Finnegan, L.L.P.

(57) ABSTRACT

A centrifugal compressor has a housing assembly and an impeller rotatably connected to the housing assembly. Gas introduced into the housing assembly by rotation of the impeller is compressed at least by centrifugal force. One aspect of the present invention is that the impeller includes an inducer portion having a pressure surface and a suction surface and a hole extending between the pressure surface and the suction surface. Another aspect of the present invention is that the centrifugal compressor includes a diffuser located downstream of the impeller, a volute in communication with an outlet of the diffuser, and a reflux passage connecting the diffuser with the volute for returning part of gas in the volute to the diffuser.

7 Claims, 13 Drawing Sheets

CENTRIFUGAL COMPRESSOR

TECHNICAL FIELD

The present invention relates to a centrifugal compressor having an impeller.

A centrifugal compressor is known as one of the compressors for compressing gas. As shown in FIG. 4, a conventional centrifugal compressor has a housing assembly 13 and a rotary shaft 12 to which an impeller 11 is secured. The housing assembly 13 includes a housing body 14 for rotatably supporting the rotary shaft 12 and a shroud housing 15. The housing body 14 contains therein a drive source (not shown) which is connected to the rotary shaft 12. The shroud housing 15 has a volute 17 and an inlet port 16 connected to the impeller 11. The housing body 14 and the shroud housing 15 cooperate to define a diffuser 18 around the impeller 11. The diffuser 18 is in communication with the volute 17 which is in turn in communication with a discharge port (not shown) of the compressor. The impeller 11 has a plurality of rotary blades 19 which are radially connected to the impeller 11. Each rotary blade 19 has an inducer portion 19*a* at the upstream portion thereof as seen in the direction of flow of fluid as indicated by arrows, for example, in FIG. 5A. The remaining portion of the rotary blade 19 is referred to as blade portion 19*b*. Although the boundary between the inducer portion 19*a* and the blade portion 19*b* is not definite, the inducer portion 19*a* is a part of the rotary blade 19 adjacent to the inlet port 16 and the remainder of the rotary blade 19 corresponds to the blade portion 19*b*.

This centrifugal compressor introduces gas into the housing assembly 13 by the rotation of the impeller 11 as indicated by arrows in FIG. 1. The introduced gas is sent to the diffuser 18 through the impeller 11 and compressed at least by centrifugal force. The gas thus compressed flows in the form of a spiral flow having a radial component of velocity and a circumferential component of velocity, and then transferred from the diffuser 18 to the volute 17.

Referring to FIGS. 5A and 5B showing cross-sectional views of the rotary blade 19, an imaginary straight line connecting the upstream blade end P (the left end of the inducer portion 19*a* in FIGS. 5A, 5B) of the rotary blade 19 and the downstream blade end Q (the right end of the blade portion 19*b* in FIGS. 5A, 5B) of the rotary blade 19 is referred to as chord line S of blade. In FIGS. 5A, 5B, the chord on the upper surface of the rotary blade 19 is longer than the chord on the lower surface. The gas flowing from the upstream blade end P toward the downstream blade end Q is separated into two flows, one moving along the upper surface and the other along lower surface of the inducer portion 19*a*, as shown in FIG. 5A. Since the two flows of gas separated simultaneously at the upstream blade end P meet at the downstream blade end Q simultaneously because of the continuity assumption of gases, the gas flow along the upper surface is faster than the gas flow along the lower surface, with the result that the pressure on the upper surface of the rotary blade 19 is lower than the pressure on the lower surface. That is, in FIGS. 5A, 5B, the lower surface of the rotary blade 19 corresponds to a pressure surface m, and the upper surface of the rotary blade 19 corresponds to a suction surface n.

The angle made between the direction of gas flow at the upstream blade end P of the inducer portion 19*a* (or the arrow T in FIGS. 5A, 5B) and the chord line S of the inducer portion 19*a* is referred to as incidence. The incidence is determined from the peripheral velocity of the upstream blade end P of the inducer portion 19*a* and the inlet velocity of gas while the impeller 11 is rotating. Accordingly, when the speed of the impeller 11 is constant, the incidence varies depending upon the flow rate of gas.

For example, when the speed of the impeller 11 is constant, the incidence becomes small with an increase in flow rate of gas, as shown in FIG. 5A. When the incidence is small, the pressure difference between the pressure surface m and the suction surface n is relatively small, with the result that the boundary layer BL (not shown in FIG. 5A) of gas is not separated from the pressure surface m and the suction surface n. As the gas flow rate reduces, the incidence increases, as shown in FIG. 5B. When the incidence is large, the pressure difference between the pressure surface m and the suction surface n is relatively large, so that the boundary layer BL of gas on the suction surface n may be separated from the suction surface n. The separation of the boundary layer BL from the suction surface n occurs easier as the incidence increases.

For the centrifugal compressor, the separation of the boundary layer BL from the suction surface n hardly occurs during the high flow rate operation shown in FIG. 5A, but there is a fear of boundary layer separation during the low flow rate operation. The separation of the boundary layer BL from the suction surface n causes a backflow. Thus, the separation of the boundary layer BL is a factor that deteriorates the performance of the compressor, causing inducer stall or surging (or self-induced vibration).

Japanese unexamined patent publication No. 8-291800 discloses a centrifugal compressor which has a fluid inlet port formed upstream of an inducer bleed hole. However, such arrangement of the compressor is designed to modulate choking that occurs downstream of an inducer throat portion by introducing gas from outside of the centrifugal compressor. Therefore, this prior art compressor is intended to improve the working efficiency of the centrifugal compressor while maintaining the efficiency of the impeller of an inducer bleed.

The conventional centrifugal compressor has a problem that the boundary layer on the suction surface of the inducer portion may be separated from the suction surface during the low flow rate operation. For preventing such separation of boundary layer, a method may be contemplated according to which the speed of the centrifugal compressor is reduced in accordance with a decrease in flow rate of gas thereby to reduce the incidence. However, the basic specifications of the centrifugal compressor are substantially determined in accordance with the required performance. Therefore, rotation of the impeller at such a low speed that is inconsistent with actual operational condition according to the basic specifications is not practical and the required centrifugal compressor performance cannot be achieved. The above problem is yet to be solved by the centrifugal compressor disclosed in Japanese unexamined patent publication No. 8-291800.

The present invention, which has been made in view of the above problems, is directed to providing a centrifugal compressor which prevents and restricts the separation of boundary layer of gas from the suction surface of inducer portion of rotary blade of the compressor even if the flow rate of gas is low.

Referring to FIG. 11 showing another conventional centrifugal type compressor similar to that of FIG. 4, the impeller 11 is arranged between the housing body 14 and the shroud housing 15. Reference is made then to FIG. 12 which shows impeller 11 and diffuser 18 of the compressor of FIG. 11. The impeller 11 includes two kinds of rotary blades (the long blades 23 and the short blades 25) which are mounted radially. The diffuser 18 is formed by housing wall 14*a* of the housing body 14 and shroud wall 15*d* of the shroud housing 15. The inlet of the diffuser 18 is located adjacent to the outer periphery of the impeller 11 and the outlet of the diffuser 18 is in communication with the volute 17 which in turn communicates with the discharge port (not shown). As shown in FIG. 12, gas compressed by rotation of the impeller 11 flows in the form of a spiral flow having radial component of velocity X and circumferential component of velocity Y. The gas in the diffuser 18 is transferred to the volute 17.

FIG. 13 is a cross-sectional view that is taken along the line I-I in FIG. 12, showing velocity gradient vg of gas flow as measured in radial direction between the housing wall 14*a* and the shroud wall 15*d*. Since the gas for compression by the centrifugal compressor is a viscous fluid, the gas flow has the peak around the middle of the velocity distribution VG and the velocity decreases toward the walls 14*a*, 15*d*.

The component of velocity of gas flow delivered from the impeller 11 includes the radial component of velocity X and the circumferential component of velocity Y relative to the impeller 11. When the amount of introduced gas is small (that is, during the low flow rate operation), the radial component of velocity X is smaller than the circumferential component of velocity Y During the low flow rate operation, part of gas flow cannot resist pressure gradient and moves back along the walls 14*a*, 15*d*. This phenomenon is called "diffuser stall".

Japanese unexamined utility model publication No. 6-76697 discloses a centrifugal compressor in which a first slit is provided in the diffuser wall of the diffuser inlet in coaxial relation to the impeller, a second slit is provided in the diffuser wall halfway through the diffuser in coaxial relation to the first slit, and the first and second slits are in communication through a bypass passage. There has been a problem with this conventional centrifugal compressor in that diffuser stall occurs during the low flow rate operation. Such diffuser stall hampers the stable operation of the centrifugal compressor. The structure disclosed in the above Japanese publication No. 6-76697 is applicable to a centrifugal compressor having a vaned diffuser. That is, this structure is designed to provide a solution for eliminating surging on the vane of the vaned diffuser, but cannot solve the above diffuser stall.

The present invention is also directed to providing a centrifugal compressor that prevents and reduces diffuser stall when the flow rate of gas is low.

SUMMARY

In accordance with the present invention, a centrifugal compressor has a housing assembly and an impeller. The impeller is rotatably connected to the housing assembly. Gas introduced into the housing assembly by rotation of the impeller is compressed at least by centrifugal force. The impeller includes an inducer portion having a pressure surface and a suction surface and a hole extending between the pressure surface and the suction surface.

In accordance with the present invention, a centrifugal compressor has a housing assembly, an impeller, a diffuser, a volute and a reflux passage. The impeller is rotatably connected to the housing assembly. The diffuser is located downstream of the impeller. The volute is in communication with an outlet of the diffuser. Gas introduced into the housing assembly by rotation of the impeller is compressed at least by centrifugal force. The reflux passage connects the diffuser with the volute for returning part of gas in the volute to the diffuser.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
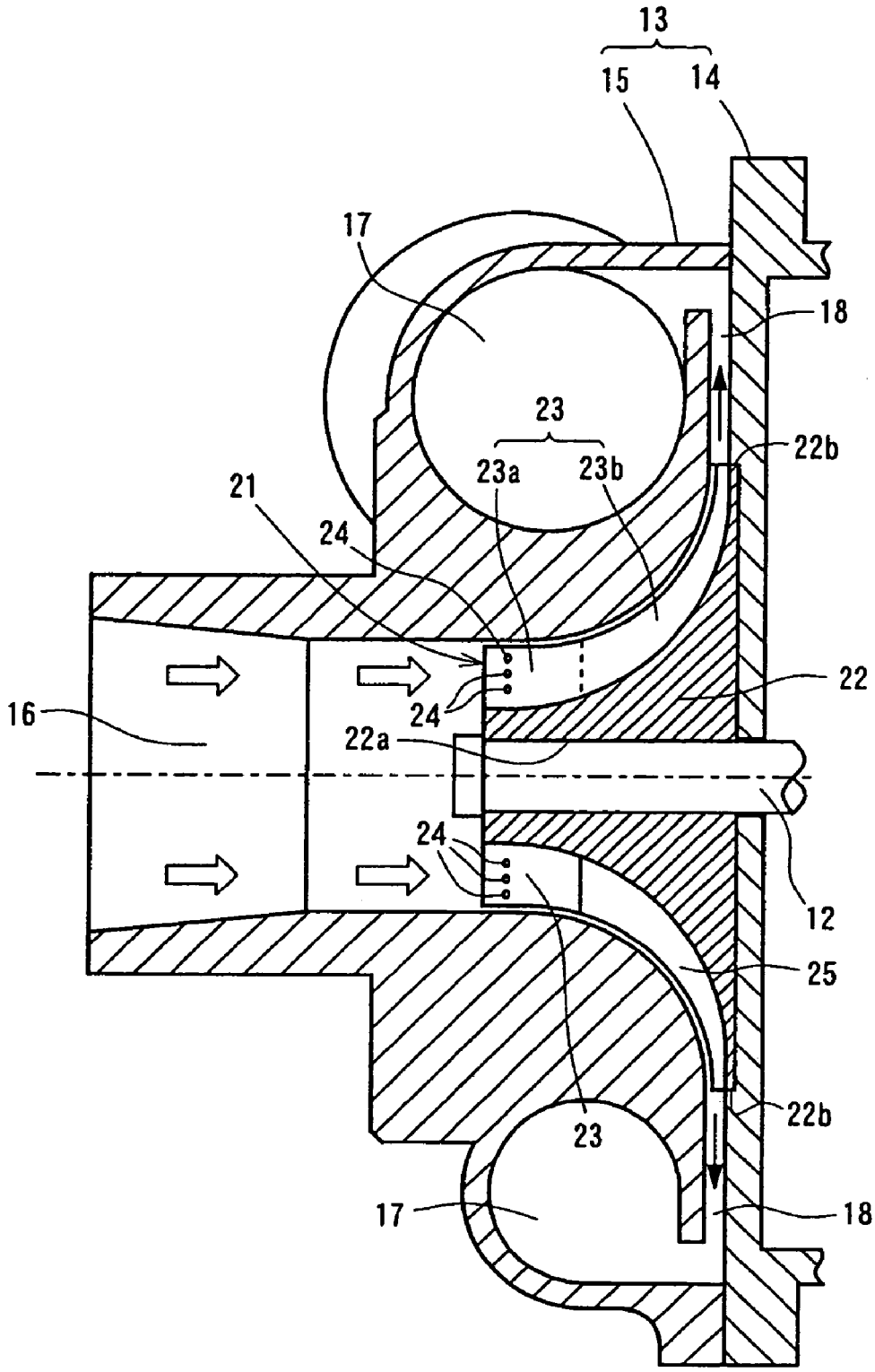
FIG. 1 is a side cross-sectional view of a centrifugal compressor according to a first preferred embodiment of the present invention.

The following will describe a first preferred embodiment of a centrifugal compressor according to the present invention with reference to FIGS. 1 through 3B. It is noted that the same reference numerals denote the components or elements substantially identical to those of the prior art and the description thereof will be omitted.

Figure 2:
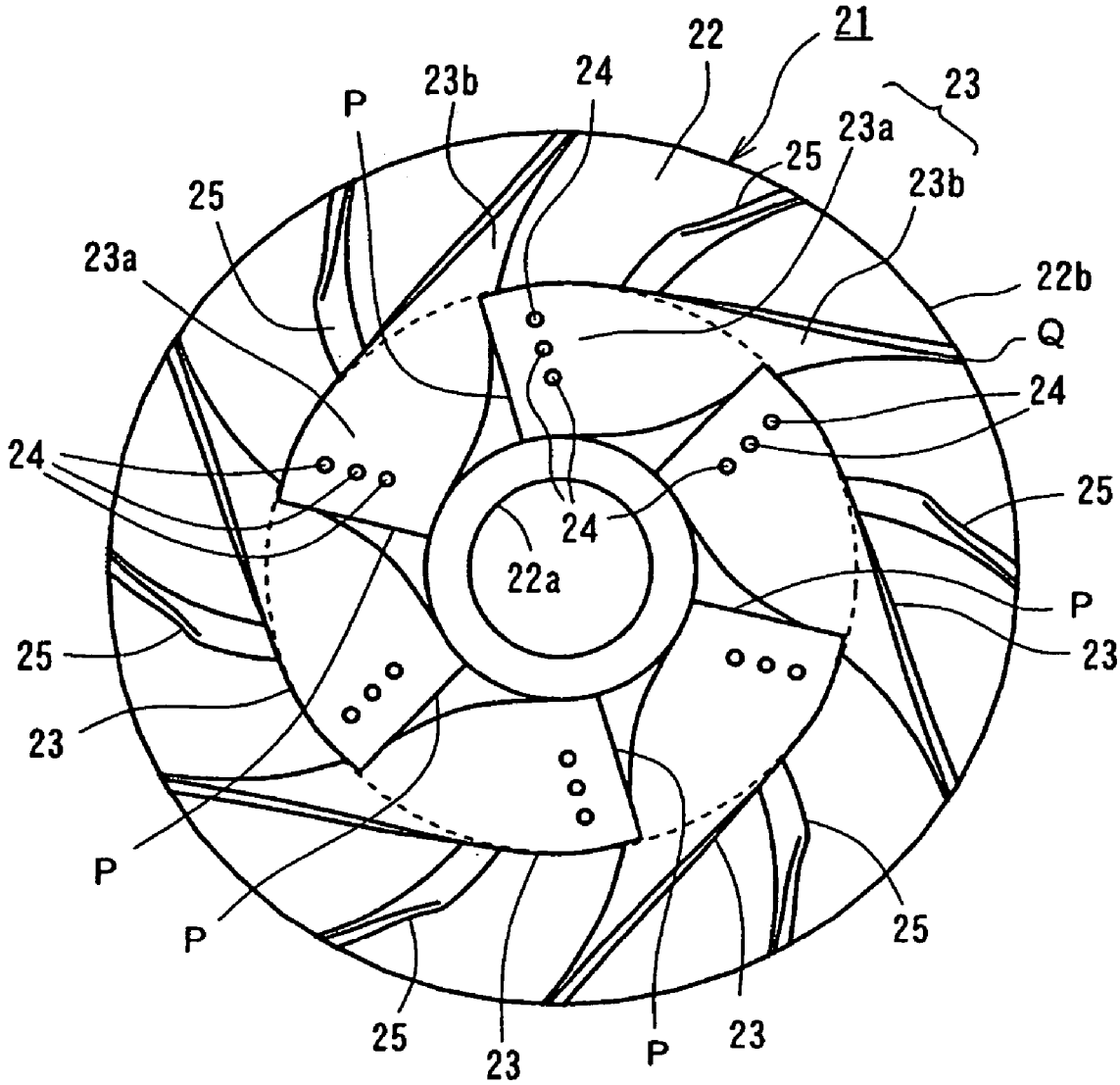
FIG. 2 is a front view of an impeller of the centrifugal compressor according to the first preferred embodiment of the present invention.
Figure 3A:
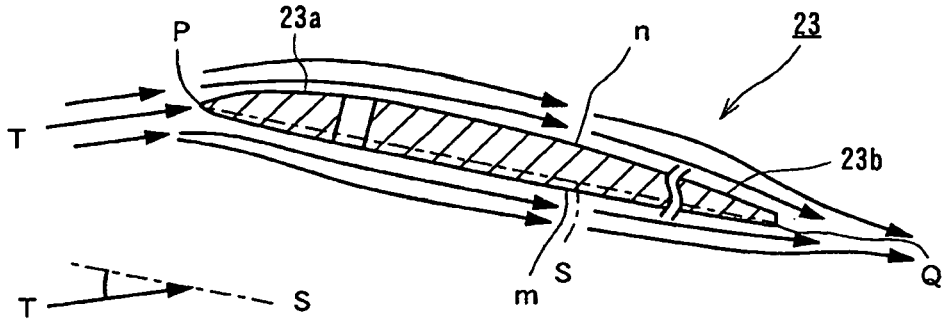
FIG. 3A is a view illustrating the flow of gas on the inducer portion during high flow rate operation of the centrifugal compressor.
Figure 3B:
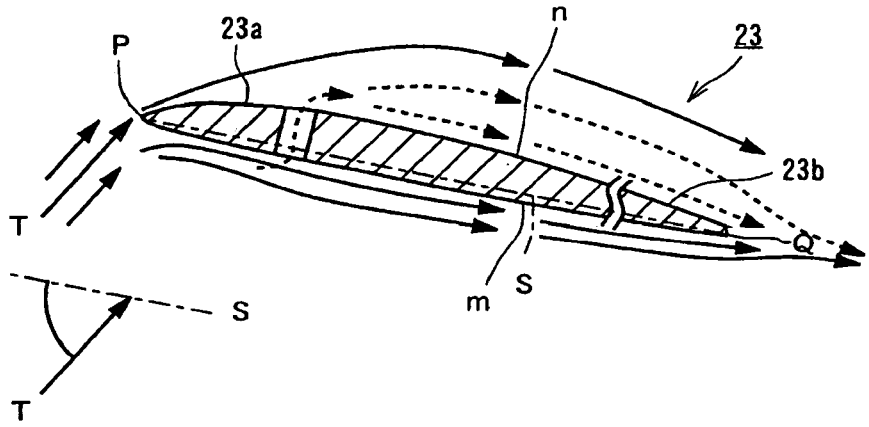
FIG. 3B is a view illustrating the flow of gas on the inducer portion during low flow rate operation of the centrifugal compressor.
Figure 4:
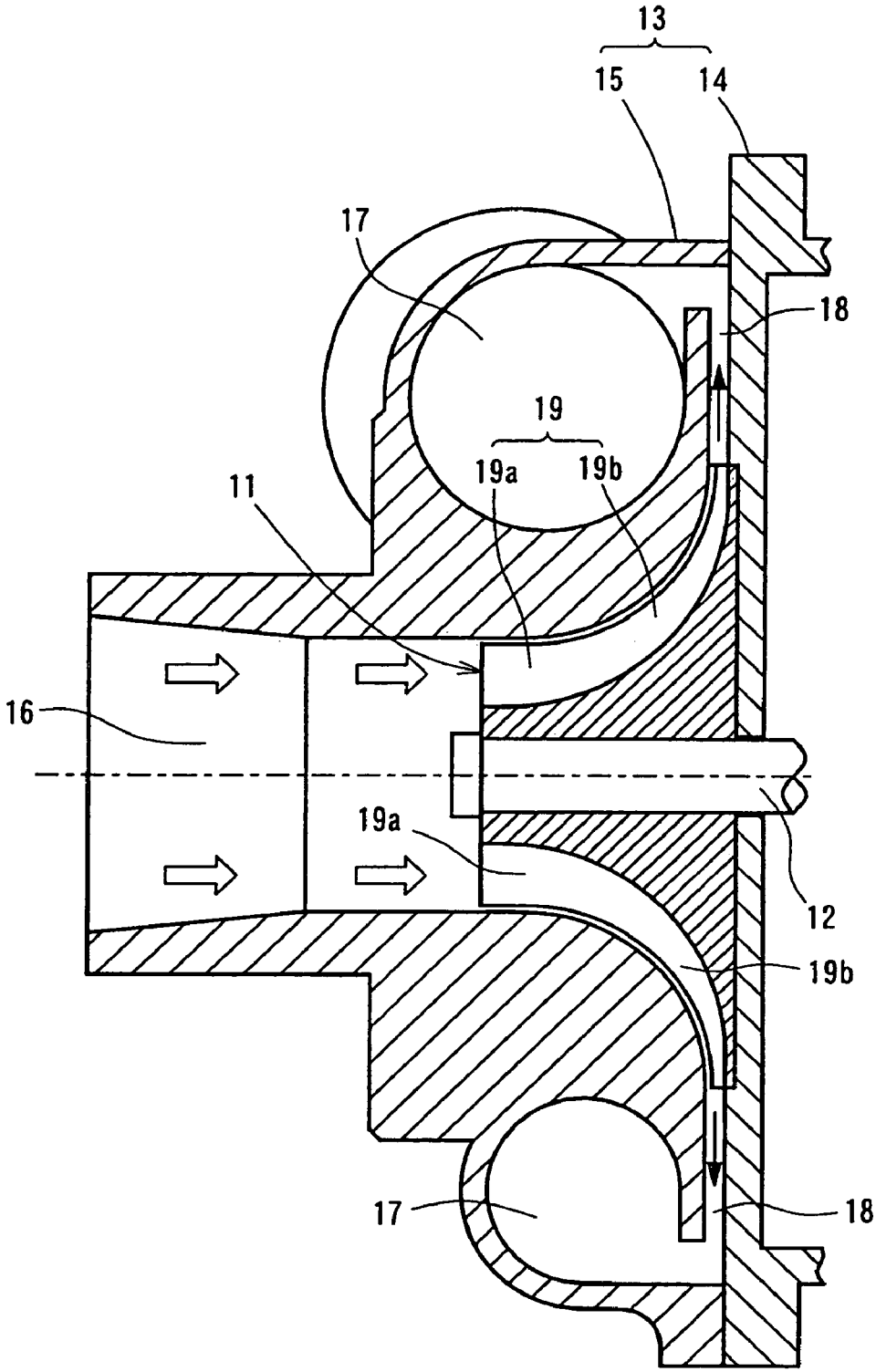
FIG. 4 (PRIOR ART)
FIG. 4 is a cross-sectional side view showing a conventional centrifugal compressor.
Figure 5A:
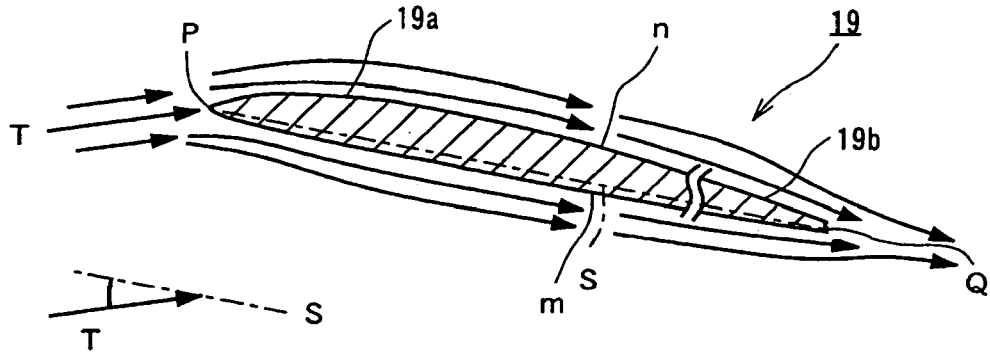
FIG. 5A (PRIOR ART)
FIG. 5A is a view illustrating the flow of gas on the inducer portion during high flow rate operation of the conventional centrifugal compressor according to a prior art.
Figure 5B:
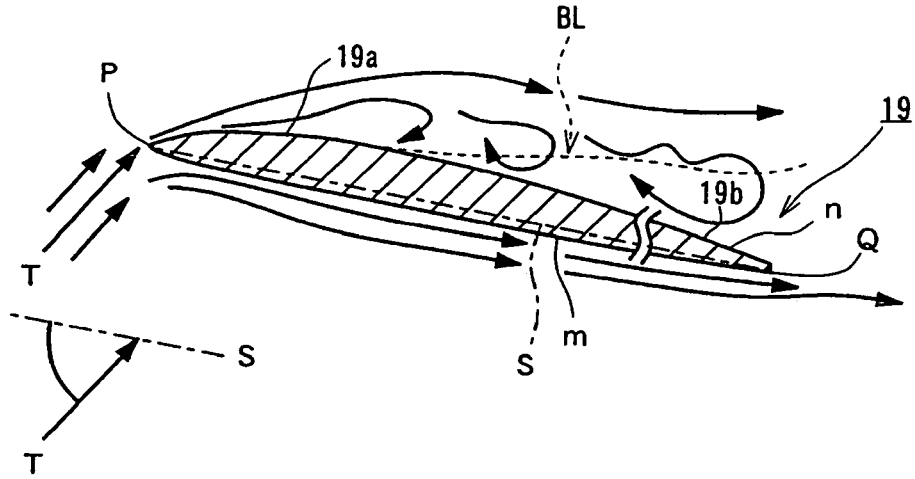
FIG. 5B (PRIOR ART)
FIG. 5B is a view illustrating the flow of gas on the inducer portion during low flow rate operation of the conventional centrifugal compressor according to the prior art.

The centrifugal compressor according to the first preferred embodiment has a housing assembly 13 and a rotary shaft 12 to which an impeller 21 is secured. FIG. 1 is a cross-sectional side view of the centrifugal compressor. FIG. 2 is a front view of inlet port 16 of the impeller 21. FIGS. 3A and 3B are cross-sectional views of rotary blade 23, illustrating the state of gas flowing during the high flow rate operation and low flow rate operation, respectively. The centrifugal compressor according to the first preferred embodiment differs from the prior art of FIG. 4 in that the impeller 21 has a different structure.

The impeller 21 shown in FIGS. 1 and 2 includes a disk 22 having a shaft hole 22*a* for receiving therethrough the rotary shaft 12 and two kinds of rotary blades 23, 25 formed radially on the disk 22. The impeller 21 is located between the housing body 14 and the shroud housing 15 and rotatable relative to the housing assembly 13. The impeller 21 in rotation draws in gas through the inlet port 16 and compresses and sends the gas to the diffuser 18 at least by the centrifugal force of the impeller 21. The disk 22 of the impeller 21 may be of a known structure.

In this embodiment, the disk 22 has two kinds of rotary blades including long blades 23 and short blades 25, as shown in FIG. 1. Six long blades 23 and short blades 25 are provided, respectively, as shown in FIG. 2, and each of the blades 23, 25 is made of a thin plate. The long blade 23 and the short blade 25 are arranged alternately on the disk 22 at an equiangular spaced interval. Therefore, a short blade 25 is located next to a long blade 23, which is next to another short blade 25.

The long blade 23 includes both inducer portion 23*a* and blade portion 23*b*, while the short blade 25 includes only a portion substantially corresponding to the blade portion 23*b* of the long blade 23. The long blade 23 extends a point adjacent to the inner peripheral edge of the shaft hole 22*a* to the outer peripheral edge 22*b* of the disk 22 while extending backward in the direction opposite to the rotational direction of the disk 22. The short blade 25 extends from a point (not shown) spaced a certain distance from the shaft hole 22*a* to the outer peripheral edge 22*b* of the disk 22 while extending backward.

The long blade 23 includes the inducer portion 23*a* located adjacent to the shaft hole 22*a* (upstream side) and the blade portion 23*b* forming the remaining portion (the downstream side of the inducer portion 23*a*). The boundary between the inducer portion 23*a* and blade portion 23*b* of the long blade 23 is shown by the dotted line in FIG. 2 for the sake of convenience but the boundary therebetween is actually not definite. The span of the inducer portion 23*a* is wider than that of the blade portion 23*b*. The upstream blade end P of the inducer portion 23*a* extends substantially in radial direction of the disk 22. The span of the blade portion 23*b* is narrower than that of the inducer portion 23*a* and becomes further narrower toward the outer peripheral edge 22*b* of the disk 22.

The inducer portion 23*a* changes the flow direction of the gas introduced by the impeller 21 and guides the gas toward the blade portion 23*b*. In the inducer portion 23*a*, the surface of the blade adjacent to the inlet port 16 is the suction surface n, and the surface of the blade adjacent to the disk 22 is the pressure surface m. In this embodiment, the impeller 21 includes the short blades 25 and the long blades 23 each having the inducer portion 23*a* and the blade portion 23*b*. In an alternative embodiment, the impeller includes only the long blades 23. In other alternative embodiments, the inducer portion 23*a* of the impeller is provided separately from the blade portion 23*b*. According to the present invention, the impeller has at least the inducer portion 23*a*. Additionally, the number of rotary blades 23, 25 is not limited to six as in the illustrated embodiment, but any number of the rotary blades 23, 25 may be provided as required.

Each inducer portion 23*a* has formed therethrough circular holes 24 which connect the pressure surface m with the suction surface n. That is, the holes 24 extend between opposite blade surfaces of the inducer portion 23*a*. In this embodiment, each inducer portion 23*a* has three holes 24 which are substantially radially arranged adjacent to the upstream blade end P of each inducer portion 23*a*. That is, these holes 24 are arranged along an imaginary line which is substantially perpendicular to the flow direction of gas at the inducer portion 23*a*. The holes 24 allow gas to pass therethrough from the pressure surface m to the suction surface n. Thus, the holes 24 prevent the boundary layer BL of gas from being separated from the suction surface n during the low flow rate operation of the centrifugal compressor. That is, the holes 24 are formed to reduce the load on the suction surface n by releasing the gas from the pressure surface m to the suction surface n.

The shape of the hole 24 is not limited to be circular as in the embodiment of FIGS. 1 through 3, but it may be elliptical, oblong, polygonal, slit or any other shapes. The dimension and the number of the holes 24 are not limited, either. According to the present invention, at least one hole 24 is provided. When a plurality of holes are provided, combination of holes having different shapes may be used. The arrangement of the holes 24 is not limited to that of FIGS. 1 and 2 wherein the holes 24 are disposed along an imaginary straight line that is substantially perpendicular to the flow direction of gas at the inducer portion 23*a*. The holes 24 may be disposed in the inducer portion 23*a* in any desired arrangement. The holes should be located at such position that prevents gas from being separated from the suction surface n during the low flow rate operation. The position may be determined appropriately in view of conditions such as performance required for the centrifugal compressor and shape of the cross-section of the inducer portion 23*a*. For example, the holes should preferably be provided adjacent to the upstream blade end P of the inducer portion 23*a* of the long blade 23. That is, the holes should be located upstream of the starting point of the separation of boundary layer from the suction surface n. It is noted, however, that the present invention does not preclude the disposition of the hole downstream of the above starting point of separation. Thus, appropriate form, position and number of the holes allow the gas on the pressure surface m to be guided to the suction surface n, and such form, position and number of the holes may be determined according to the condition of separation of boundary layer from the inducer portion 23*a* so that the separation is prevented most effectively.

FIG. 3A shows the rotary blade 23 in cross section and the flow of gas indicated by arrows during the high flow rate operation of the centrifugal compressor. When the centrifugal compressor operates at a high flow rate, the incidence of gas to the inducer portion 23*a* becomes smaller than that during the low flow rate operation. During the high flow rate operation in which the incidence is sufficiently set small, the boundary layer BL (not shown in FIG. 3A) of the gas on the suction surface n of the inducer portion 23*a* is not easily separated from the suction surface n. That is, a smaller incidence reduces the generation of unstable air flow around the inducer portion 23*a*. The pressure on the suction surface n is lower than that on the pressure surface m during the high flow rate operation, with the result that part of the gas flows from the pressure surface m to the suction surface n through the holes 24. Part of the gas then passing through the holes 24 will not significantly affect the operation of the centrifugal compressor during the high flow rate operation.

FIG. 3B is a sectional view similar to FIG. 3A, but showing the flow of gas indicated by arrows during the low flow rate operation. When the centrifugal compressor operates at a low flow rate, the incidence of gas to the inducer portion 23*a* becomes larger than that during the high flow rate operation. During the low flow rate operation when the incidence becomes large, the boundary layer BL of gas on the suction surface n of the inducer portion 23*a* is easily separated from the suction surface n. Then, the holes 24 allow part of the gas on the pressure surface m to flow therethrough to the suction surface n. The boundary layer BL (not shown in FIG. 3B) of gas on the suction surface n is not easily separated due to the gas flown from the pressure surface m. That is, part of the gas (which is indicated by the dotted arrows in FIG. 3B) passing through the holes 24 during the low flow rate operation prevents or reduces separation of the boundary layer BL from the suction surface n.

According to the first preferred embodiment, the following advantages are obtained.

(1) The impeller 21 includes the inducer portion 23*a* having the pressure surface m and the suction surface n and the holes 24 connecting the pressure surface m with the suction surface n. Therefore, during the low flow rate operation, part of gas passes from the pressure surface m to the suction surface n via the holes, with the result that separation between the suction surface n and the boundary layer BL is prevented and the inducer stall and surging are prevented or reduced, accordingly. That is, the centrifugal compressor is stably operated.

(2) The provision of a plurality of the holes 24 in the embodiment of FIGS. 1 through 3 helps to reduce the possibility of impairing the required function of the inducer portion 23*a*. That is, allowing part of the gas to pass through a plurality of the holes, the degree of freedom of preventing or reducing the separation of the boundary layer BL from the suction pressure n is improved over the provision of a single hole.

(3) Since a plurality of the holes 24 are arranged in radial direction of the impeller 21, they prevent or reduce the separation of the boundary layer BL along the direction perpendicular to the gas flow (or in the width direction of the blade), with the result that separation of the boundary layer BL from the inducer portion 23*a* is prevented.

(4) The provision of the holes 24 through the inducer portion 23*a* will not give a remarkable influence on the function of the inducer portion 23*a* during the high flow rate operation of the compressor. Therefore, the performance of the centrifugal compressor during the high flow rate operation is maintained the same as the conventional centrifugal compressor.

(5) Merely forming the holes 24 through the inducer portion 23*a*, separation between the suction surface n and the boundary layer BL can be prevented or reduced. Therefore, the conventional centrifugal compressor may be modified into a centrifugal compressor capable of preventing or reducing the separation between the suction surface n and the boundary layer BL merely by forming holes through the inducer portion 23*a*.

The following will describe a second preferred embodiment of a centrifugal compressor according to the present invention with reference to FIGS. 6 through 9. It is noted that the same reference numerals denote substantially identical components or elements to those of the prior art and the first preferred embodiment, and the detailed description of such components and elements will be omitted.

Figure 6:
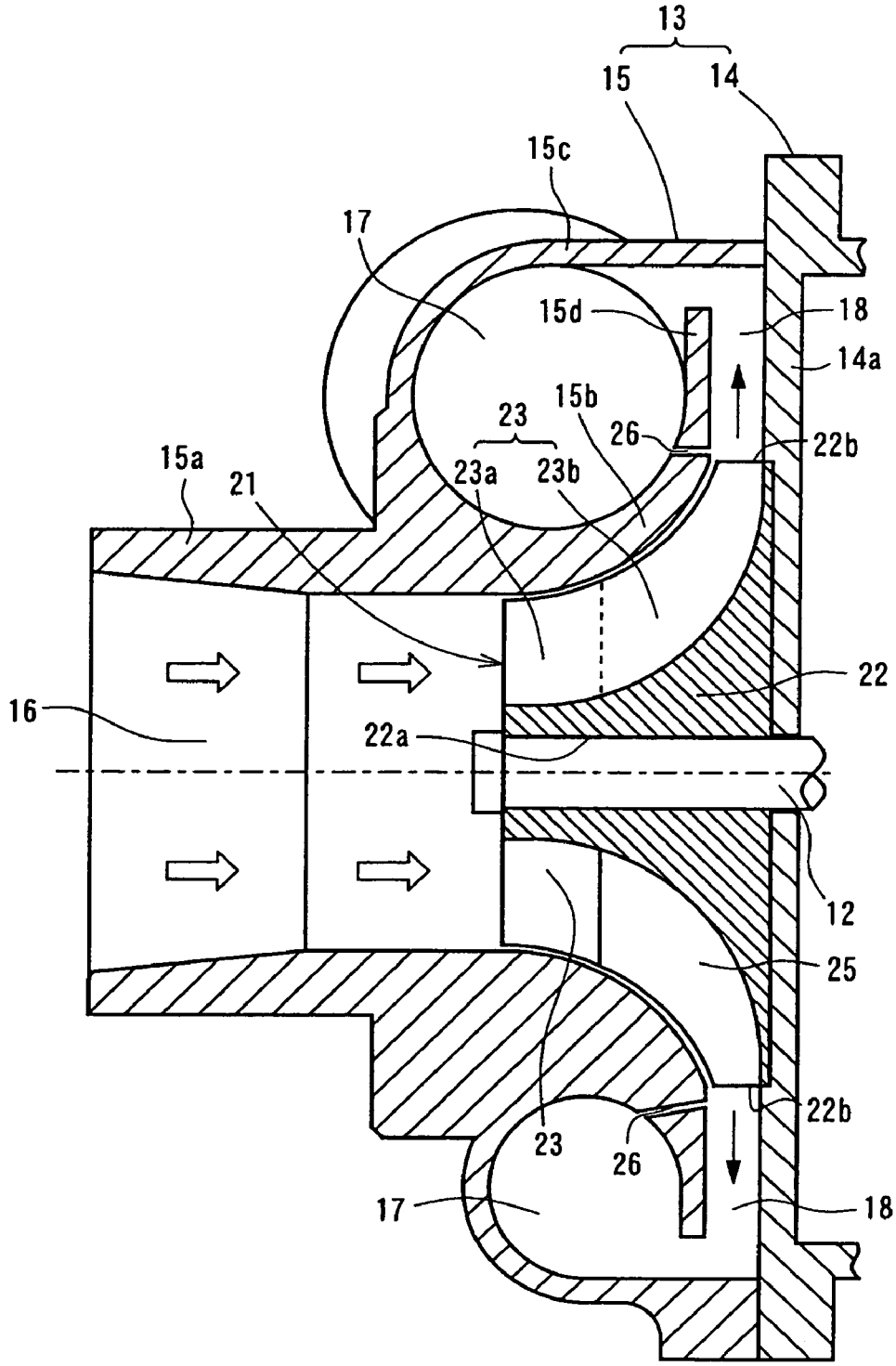
FIG. 6 is a side cross-sectional view of a centrifugal compressor according to a second preferred embodiment of the present invention.
Figure 7:
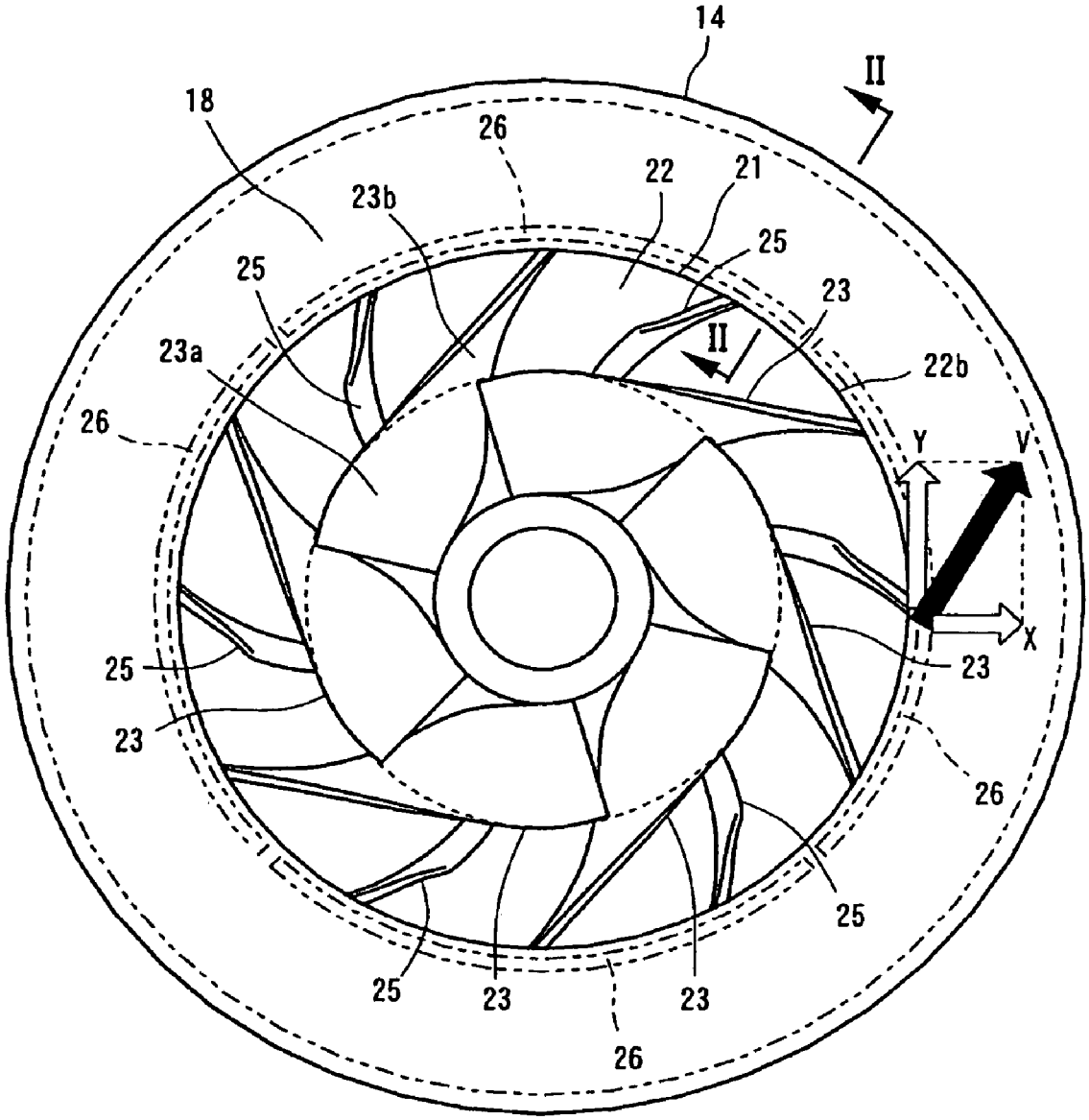
FIG. 7 is a front view of an impeller and a diffuser of the centrifugal compressor according to the second preferred embodiment of the present invention.
Figure 8:
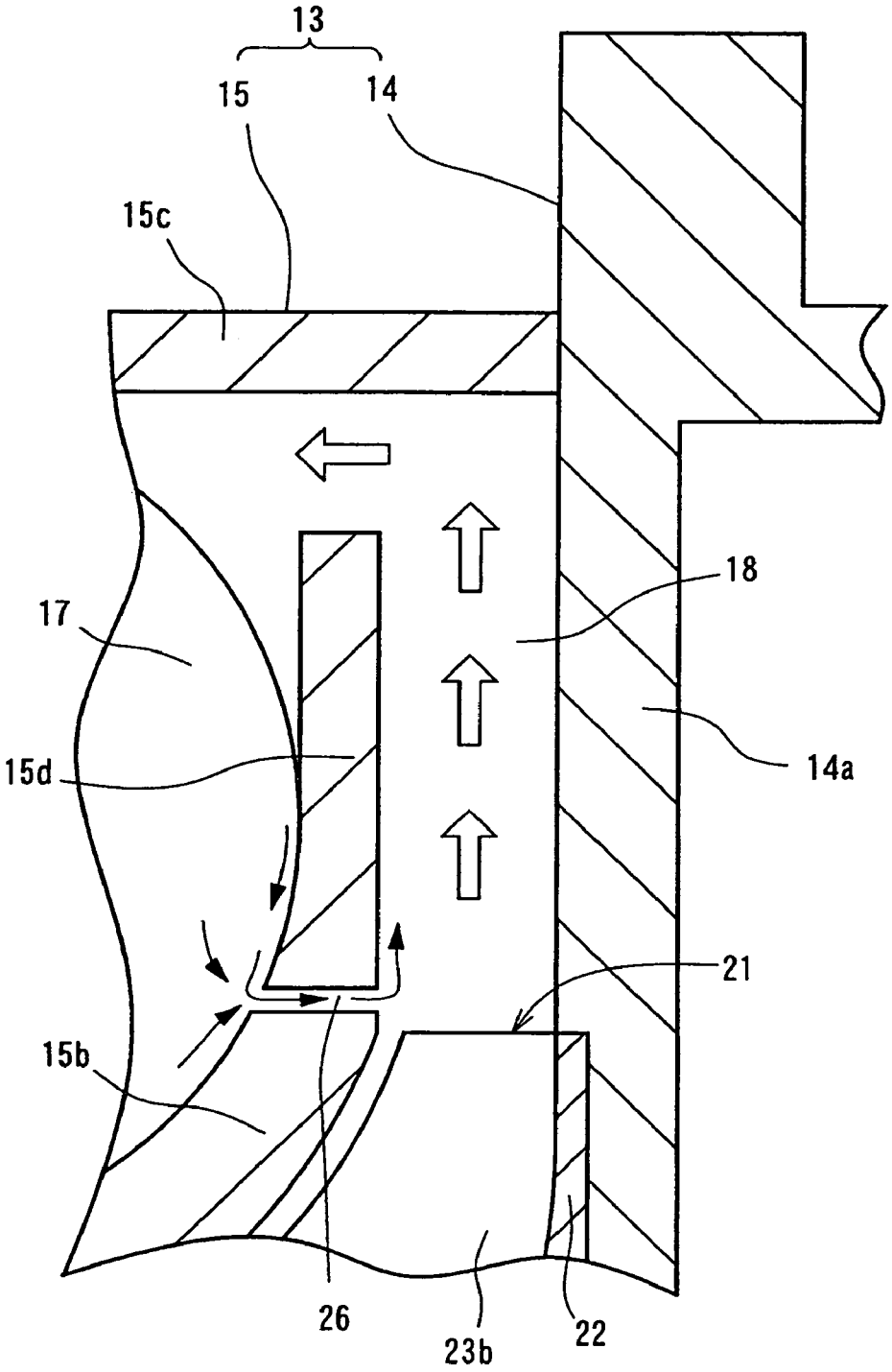
FIG. 8 is an enlarged cross-sectional view of a portion around a reflux passage of the centrifugal compressor according to the second preferred embodiment of the present invention.
Figure 9:
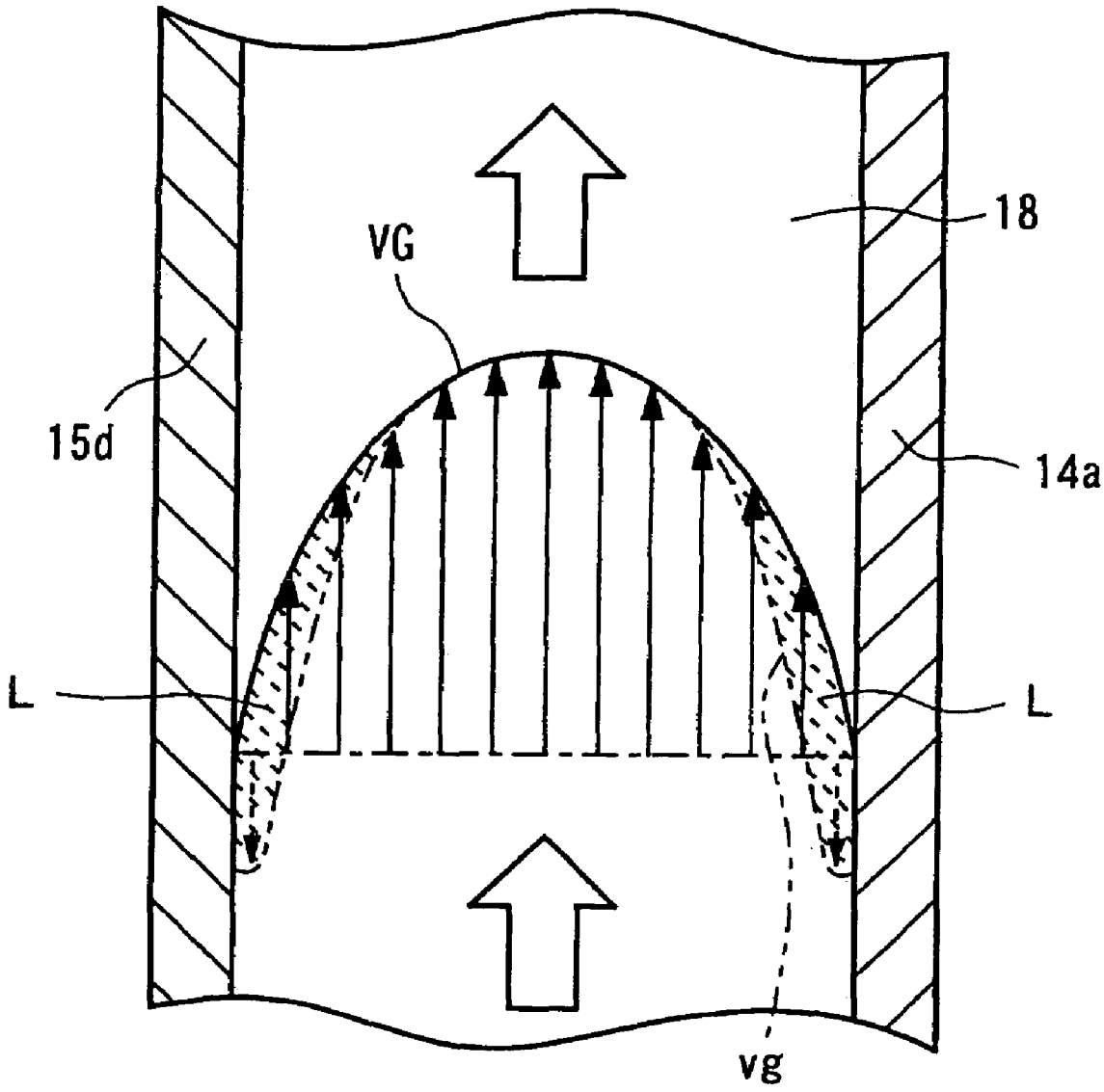
FIG. 9 is a cross-sectional view that is taken along the line II-II in FIG. 7, showing velocity distribution as measured in radial direction between a housing wall and a shroud wall near the inlet of the diffuser.

FIG. 6 is a side cross-sectional view of a centrifugal compressor of the second preferred embodiment. FIG. 7 is a front view of the inlet port 16 of the impeller 21 and the diffuser 18 of the compressor of FIG. 6. FIG. 8 is an enlarged cross-sectional view of a portion of the compressor around a reflux passage which will be described in later part hereof. FIG. 9 is a cross-sectional view that is taken along the line II-II in FIG. 7, showing velocity distribution around the inlet of the diffuser 18. The centrifugal compressor according to the second preferred embodiment differs from the conventional centrifugal compressor in that the shroud housing 15 has a different structure. The impeller may include the inducer portion 23*a* that is provided separately from the blade portion 23*b*. Additionally, the impeller may be so formed that it does not include a definite inducer portion 23*a*. The number of rotary blades that form the impeller and the kind of such rotary blade are not limited, but may appropriately be determined based upon requirements for the centrifugal compressor.

The shroud housing 15 shown in FIG. 6 includes an inlet port wall 15*a* which forms the inlet port 16, a shroud portion 15*b* formed in a complementary manner with respect to the impeller 21, a volute wall 15*c* which forms the outline of the volute 17 and a shroud wall 15*d* which separates the diffuser 18 from the volute 17. The inlet port wall 15*a* forms the cylindrical inlet port 16 upstream of the impeller 21 with respect to the flowing direction of gas, or leftward as seen in FIG. 6. The shroud portion 15*b* is formed with a curve complementary of the impeller 21, extending from the inlet port 16 of the impeller 21 to a position near the inlet of the diffuser 18. The volute wall 15*c* forms the volute 17 having a circular cross-section, and the end surface of the volute wall 15*c* is in contact with the housing wall 14*a*. The shroud wall 15*d* separates the diffuser 18 from the volute 17 and defines the diffuser 18 with the opposite housing wall 14*a*. Accordingly, the volute 17 is formed by the shroud portion 15*b*, the volute wall 15*c* and the shroud wall 15*d*.

The diffuser 18 has its inlet located near the outer peripheral edge 22*b* of the impeller 21 and its outlet near the volute 17. The diffuser 18 performs the function of converting kinetic energy of gas from the impeller 21 into pressure energy. The outlet of the diffuser 18 is in communication with the volute 17, and the outer peripheral end of the shroud wall 15*d* is located adjacent to the outlet of the diffuser 18. Thus, the diffuser 18 is located downstream of and around the impeller 21.

The shroud wall 15*d* has a reflux passage 26 that connects the volute 17 with the diffuser 18 for returning part of high-pressure gas in the volute 17 to the diffuser 18. Gas flowing from the volute 17 back to the diffuser 18 through the reflux passage 26 is called reflux gas hereinafter. The reflux passage 26 is designed to increase the radial component of velocity X of the gas in the diffuser 18 by the reflux gas. The outlet of the reflux passage 26 is located near the inlet of the diffuser 18, and the inlet of the reflux passage 26 is located so as to shorten the reflux passage 26 as much as possible. Therefore, the reflux passage 26 is located substantially between the shroud portion 15*b* and the shroud wall 15*d*. The object of the shortened reflux passage 26 is to reduce pressure loss resulting from passing of the reflux gas through the reflux passage 26. The shortened reflux passage 26 permits feeding of gas at the desired flow rate for increasing the radial component of velocity X of the gas in the diffuser 18.

The reflux passage 26 is formed of the combination of four circular arc shaped slits, as indicated by the dotted line in FIG. 7. Thus, the reflux passage 26 is formed along substantially the entire circumference of the diffuser 18. The reflux passage 26 is not limited to the form of a slit, but may be provided by forming a number of holes. The shape, number and position of the reflux passage 26 may appropriately be determined as far as the reflux passage 26 can perform the function of allowing the reflux gas to pass therethrough. In this embodiment, since the volute 17 is separated from the diffuser 18 by the shroud wall 15*d*, the volute 17 and the diffuser 18 are arranged in axial direction of the rotary shaft 12. However, the reflux passage 26 may be formed irrespective of arrangement of the volute 17 and the diffuser 18. For example, the volute 17 may be provided on the outer side of the diffuser 18. In this case, the reflux passage is preferably formed by any suitable member for forming a passage, such as a pipe.

FIG. 8 shows part of the centrifugal compressor during the low flow rate operation. When the centrifugal compressor is operating at a low flow rate, the gas transferred to the diffuser 18 by the impeller 21, as indicated by outline arrows in FIG. 8, passes the diffuser 18 and reaches the volute 17. The volute 17 is higher in pressure than the diffuser 18. Therefore, part of the gas in the volute 17 flows to the diffuser 18 through the reflux passage 26 as reflux gas, as indicated by solid arrows in FIG. 8. The reflux gas joins the gas flowing from the impeller 21 near the inlet of the diffuser 18. The reflux gas joined by the gas from the impeller 21 increases the radial component of velocity X in FIG. 7. That is, the gas present in the diffuser 18 has a radial component of velocity of the gas flowing from the impeller 21 and the radial component of velocity which is added at least by the reflux gas.

FIG. 9 is a cross-sectional view taken along the line II-II in FIG. 7, showing the velocity distribution VG of the gas flow as measured between the housing wall 14*a* and the shroud wall 15*d* during the low flow rate operation of the compressor. In FIG. 9, the outline arrows indicate the general flow of gas, and the solid arrows with various lengths depict the flow of gas and the velocities indicated by the arrow lengths. In FIG. 9, the velocity distribution vg of a centrifugal compressor having no reflux passage 26 is shown by the dotted lines. In this embodiment, the part of the low speed region L (hatched area in FIG. 9) which appears in a centrifugal compressor having no reflux passage 26 is eliminated. Thus, the backflow of gas along and adjacent to the walls 14*a*, 15*d* is prevented or reduced. This is because the reflux gas joined by the gas from the impeller 21 increases the radial component of velocity X and at least part of the low speed region L near the wall surface, which otherwise causes the backflow, is modified as shown in FIG. 9. The reflux gas serves to eliminate part of the low speed region L shown in FIG. 9. That is, a relative increase in flow rate due to the reflux gas to the inlet of the diffuser 18 causes the radial component of velocity (momentum) of gas to be increased and the low speed region L of the boundary layer on the wall surface to be reduced, thereby preventing the backflow.

When the centrifugal compressor is operated at a high flow rate, gas in the volute 17 passes through the reflux passage 26 toward the diffuser 18. The flow of reflux gas to the diffuser 18 will not give a significant influence on the performance of the centrifugal compressor. If there should be a fear that the performance of the centrifugal compressor is affected slightly by the reflux gas, the centrifugal compressor may be designed in view of the flow of the reflux gas to the diffuser 18.

According to the second preferred embodiment, the following advantages are obtained.

(1) The above centrifugal compressor has the reflux passage 26 for connecting the diffuser 18 with the volute 17 and returns part of the gas in the volute 17 to the diffuser 18. The gas present in the diffuser 18 has the radial component of velocity of gas flowing from the impeller 21 and additional velocity of gas (or reflux gas) flowing to the diffuser 18 through the reflux passage 26. The added velocity reduces the low speed region near the wall surface and hampers the generation of backflow. Accordingly, diffuser stall can be prevented or reduced during the low flow rate operation of the compressor.

(2) In the above-described centrifugal compressor, the outlet of the reflux passage 26 is located near the inlet of the diffuser 18. Therefore, the gas in the diffuser 18 receives relatively early the additional radial component of velocity of the reflux gas from the reflux passage 26. Accordingly, diffuser stall rarely occurs in the region between the locations that are adjacent to the inlet and the outlet of the diffuser 18, respectively.

(3) In the above centrifugal compressor, the reflux passage 26 is formed straight and, therefore, pressure loss of the reflux gas in the reflux passage 26 is easily reduced, with the result that additional radial component of velocity X is achieved while minimizing the pressure loss.

(4) Diffuser stall can be prevented or suppressed merely by providing the reflux passage 26. Therefore, the advantage of preventing or suppressing the diffuser stall according to the present invention can be achieved also in a conventional centrifugal compressor merely by forming a reflux passage to the diffuser.

Figure 10:
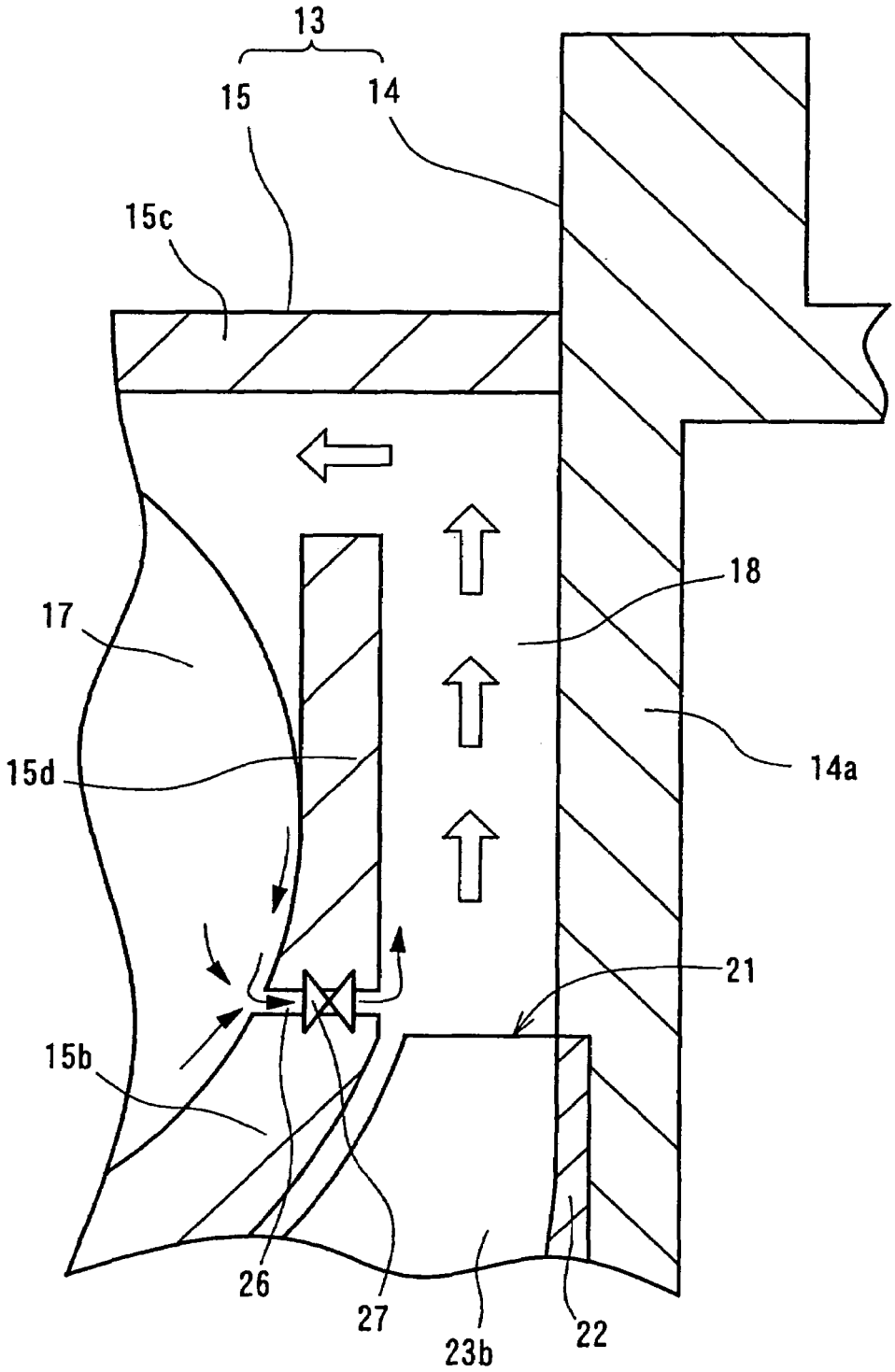
FIG. 10 is an enlarged cross-sectional view of a portion around a reflux passage of a centrifugal compressor according to a third preferred embodiment of the present invention.
Figure 11:
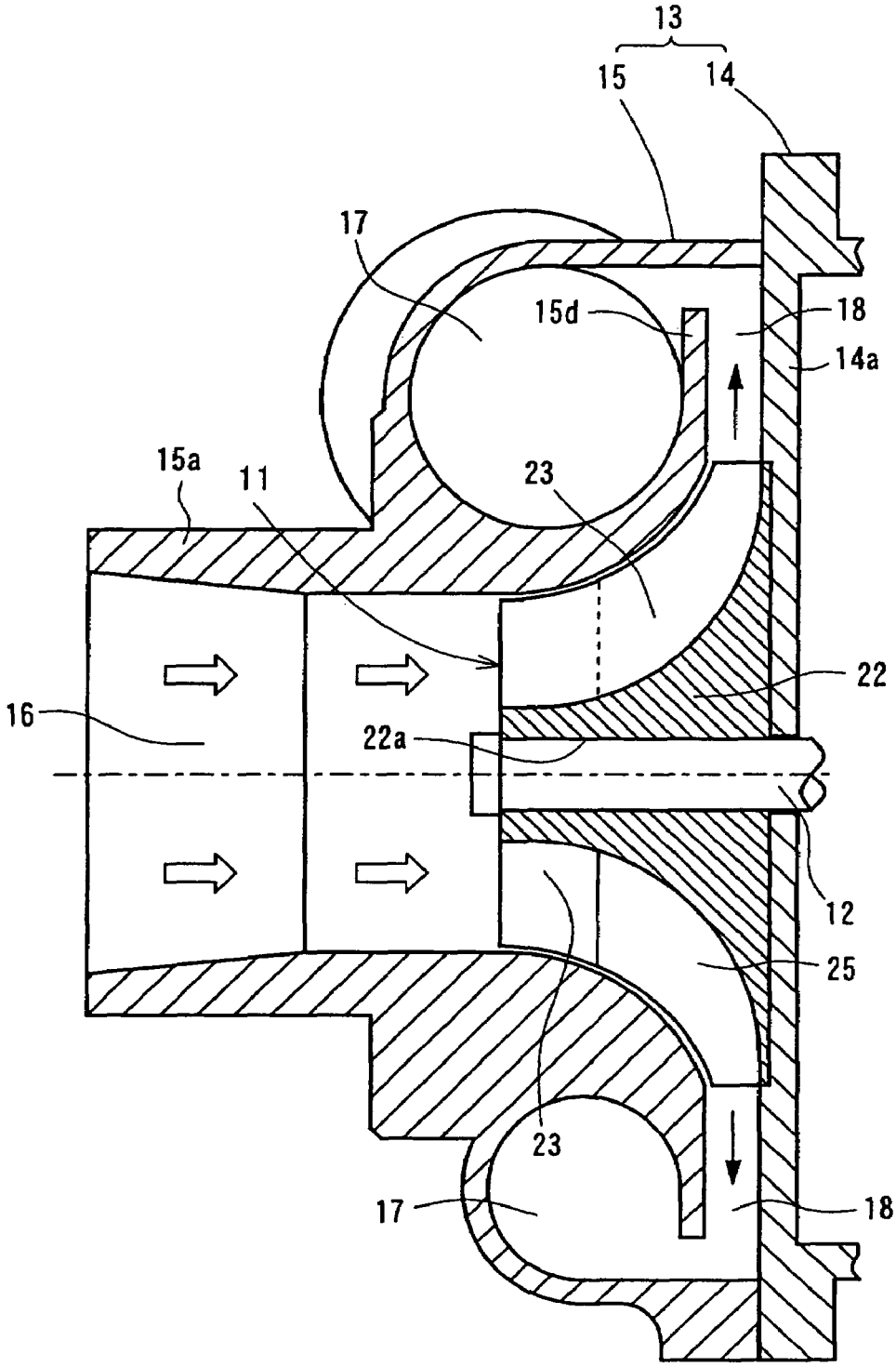
FIG. 11 (PRIOR ART)
FIG. 11 is a side cross-sectional view of a centrifugal compressor according to a prior art.
Figure 12:
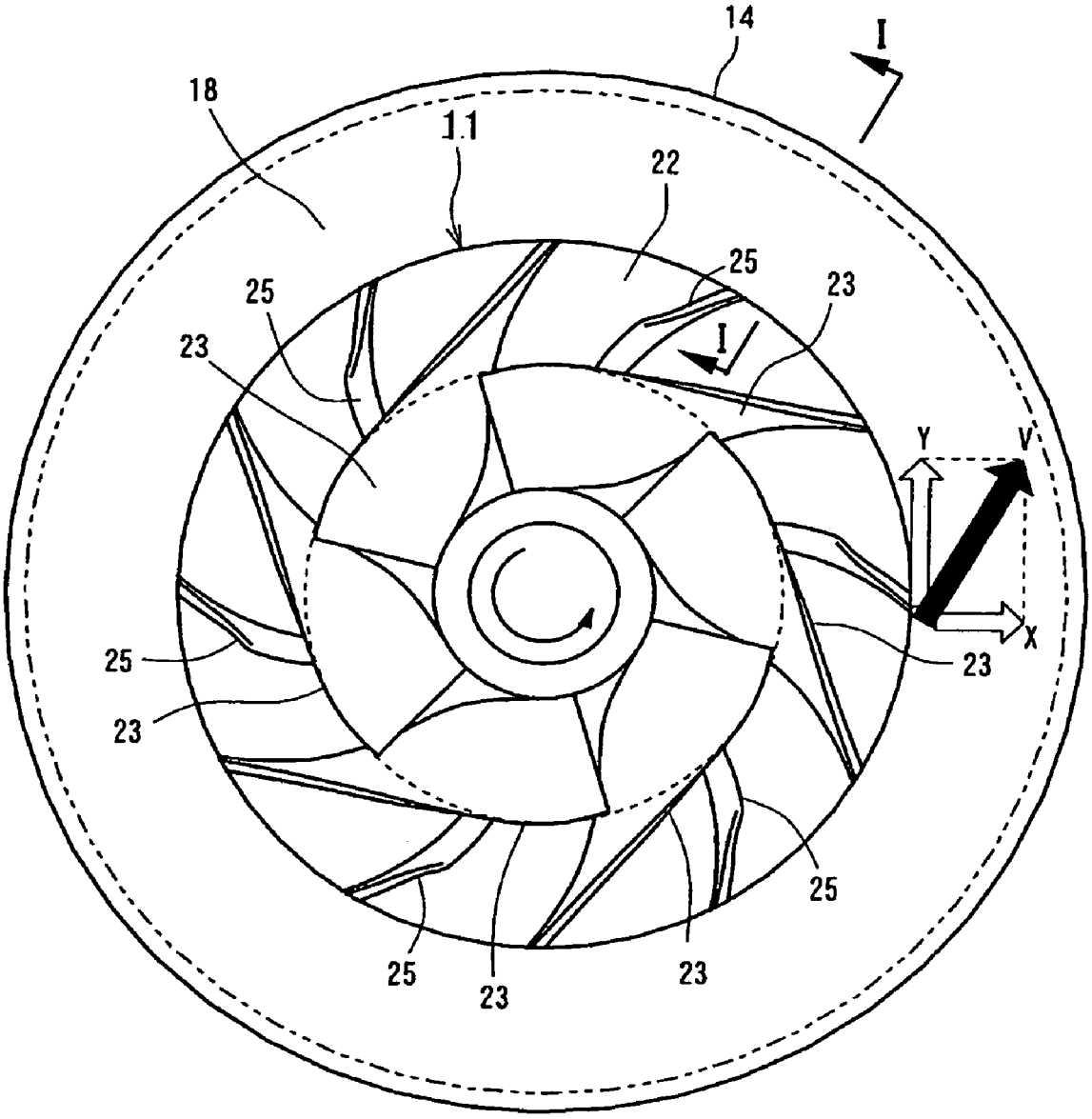
FIG. 12 (PRIOR ART)
FIG. 12 is a front view of an impeller and a diffuser of the centrifugal compressor according to the prior art.
Figure 13:
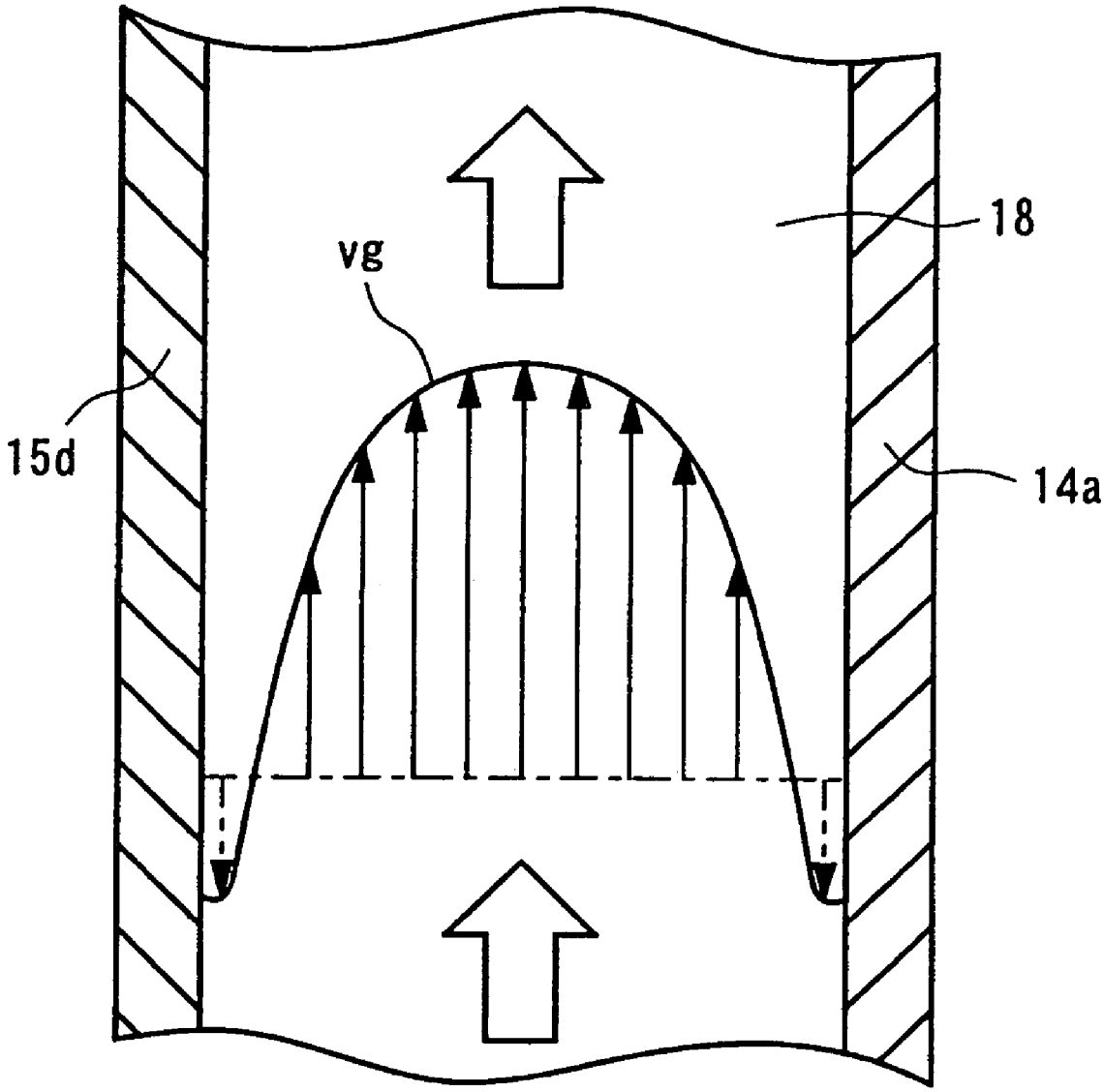
FIG. 13 (PRIOR ART)
FIG. 13 is a cross-sectional view that is taken along the line I-I in FIG. 12, showing velocity distribution as measured in radial direction between a housing body and a shroud housing near the inlet of the diffuser.

The following will describe a third preferred embodiment of the centrifugal compressor according to the present invention with reference to FIG. 10. FIG. 10 is a partially enlarged cross-sectional view of a portion of the centrifugal compressor around the reflux passage 26. It is noted that the same reference numerals denote the substantially identical components or elements to those of the second preferred embodiment, and the detailed description of such components or elements will be omitted.

As shown in FIG. 10, the reflux passage 26 has a valve 27 which allows or blocks the gas flow through the reflux passage 26. The valve 27 in this embodiment is operable to close the reflux passage 26 during the high flow rate operation and to open the reflux passage 26 during the low flow rate operation. That is, the valve 27 opens or closes the reflux passage 26 in accordance with the operating condition of the centrifugal compressor. Though the valve 27 is not limited to a specific kind or form of valve, the valve should preferably be opened or closed automatically in accordance with the operating condition of the centrifugal compressor. A means for opening and closing the valve 27 and a control therefor may be selected from known devices. Furthermore, the valve 27 should preferably be opened or closed based upon the pressure difference between the volute 17 and the diffuser 18. For example, a flexible reed valve or the like may be used.

The provision of the valve 27 which is operable to close during the high flow rate operation eliminates the adverse effect on the performance of the centrifugal compressor by the reflux gas flowing to the diffuser 18. Therefore, the centrifugal compressor may be designed without consideration of the reflux gas flowing to the diffuser 18 during the high flow rate operation. Since the valve 27 opens during the low flow rate operation, the same advantages as those of the second preferred embodiment are obtained.

The above-described centrifugal compressor has the valve 27 in the reflux passage 26 which is operable to control the reflux gas flows through the reflux passage 26 in accordance with the operating condition of the centrifugal compressor. Accordingly, the operating condition of the centrifugal compressor may be set without consideration of the disadvantages of the reflux gas flowing to the diffuser 18.

The reflux gas flows to the diffuser 18 during the low flow rate operation of the centrifugal compressor when the valve 27 is opened, while the flow of reflux gas is inhibited during compressor operation other than the low flow rate operation when the valve 27 is then closed. Accordingly, the centrifugal compressor prevents or reduces diffuser stall during the low flow rate operation. Additionally, the centrifugal compressor will not be affected by the reflux gas during the compressor operation other than the low flow rate operation.

The present invention is not limited to the embodiments described above but may be modified into alternative embodiments.

In an alternative embodiment to the first preferred embodiment, any known components or means may be used for the components of the centrifugal compressor other than the inducer portion.

In an alternative embodiment to the second and third preferred embodiments, any known components or means may be used for the components of the centrifugal compressor other than the shroud housing 15.

Therefore, the present examples and embodiments are to be considered as illustrative and not restrictive, and the invention is not to be limited to the details given herein but may be modified within the scope of the appended claims.

What is claimed is:

1. A centrifugal compressor comprising:

a housing assembly;

an impeller rotatably connected to the housing assembly;

a diffuser located downstream of the impeller;

a volute in communication with an outlet of the diffuser, wherein gas introduced into the housing assembly by rotation of the impeller is compressed at least by centrifugal force; and a reflux passage connecting the diffuser with the volute for returning part of gas in the volute to the diffuser, wherein a valve is provided in the reflux passage.

2. The centrifugal compressor according to claim 1, wherein an outlet of the reflux passage is located near an inlet of the diffuser.

3. The centrifugal compressor according to claim 1, wherein the reflux passage is formed straight.

4. The centrifugal compressor according to claim 1, wherein the valve is opened during low flow rate operation of the compressor.

5. The centrifugal compressor according to claim 1, wherein the valve is closed during high flow rate operation of the compressor.

6. The centrifugal compressor according to claim 1, wherein the valve is of a flexible reed type.

7. A centrifugal compressor comprising:

a housing assembly;

an impeller rotatably connected to the housing assembly, wherein gas introduced into the housing assembly by rotation of the impeller is compressed at least by centrifugal force, wherein the impeller includes: an inducer portion having a pressure surface and a suction surface; and a hole extending between the pressure surface and the suction surface;

a diffuser located downstream of the impeller;

a volute in communication with an outlet of the diffuser; and a reflux passage connecting the diffuser with the volute for returning part of gas in the volute to the diffuser.

* * * * *

UNITED STATES PATENT AND TRADEMARK OFFICE

CERTIFICATE OF CORRECTION

PATENT NO. : 7,261,513 B2
APPLICATION NO. : 11/280147
DATED : August 28, 2007
INVENTOR(S) : Ryo Umeyama et al.

It is certified that error appears in the above-identified patent and that said Letters Patent is hereby corrected as shown below:

Column 1, line 45, please delete "chord line S of blade." and insert therefore -- chord line S of the blade. --;

Column 2, line 58, please delete "suction surface of inducer" and insert therefore -- suction surface of the inducer --.

Column 2, line 59, please delete "portion of rotary blade" and insert therefore -- portion of the rotary blade --;

Column 3, line 14, please delete "measured in radial direction" and insert therefore -- measured in the radial direction --;

Column 3, line 26, please delete "velocity Y During" and insert therefore -- velocity Y. During --;

Column 3, line 27, please delete "part of gas flow" and insert therefore -- part of the gas flow --;

Column 4, lines 48-49, please delete "measured in radial direction" and insert therefore -- measured in a radial direction --;

Column 4, line 60, please delete "in radial direction" and insert therefore -- in a radial direction --;

Column 5, lines 55-56, please delete "in radial direction" and insert therefore -- in a radial direction --;

Column 5, line 58, please delete "becomes further narrower" and insert therefore -- becomes more narrow --;

Column 6, line 29, please delete "any other shapes" and insert therefore -- any other shape --;

Column 7, line 29, please delete "advantages are obtained." and insert therefore -- advantages are obtained: --;

Column 7, line 47, please delete "suction pressure n" and insert therefore -- suction surface n --;

UNITED STATES PATENT AND TRADEMARK OFFICE

CERTIFICATE OF CORRECTION

PATENT NO. : 7,261,513 B2
APPLICATION NO. : 11/280147
DATED : August 28, 2007
INVENTOR(S) : Ryo Umeyama et al.

It is certified that error appears in the above-identified patent and that said Letters Patent is hereby corrected as shown below:

Column 7, line 49, please delete "arranged in radial" and insert therefore -- arranged in a radial --;

Column 9, line 8, please delete "arc shaped slits" and insert therefore -- arc-shaped slits --;

Column 9, line 18, please delete "in axial direction" and insert therefore -- in an axial direction --;

Column 10, line 2, please delete "diffuser 18 will not give" and insert therefore -- diffuser 18 will not have --;

Column 10, line 9, please delete "advantages are obtained." and insert therefore -- advantages are obtained: --;

Column 10, line 56, please delete "Though the valve 27" and insert therefore -- Although the valve 27 --; and Column 11, line 11, please delete "reflux gas flows" and insert therefore -- reflux gas flow --.

Signed and Sealed this

Twenty-fifth Day of August, 2009

David J. Kappos

David J. Kappos
*Director of the United States Patent and Trademark Office*